US006234475B1

(12) United States Patent
Weigel et al.

(10) Patent No.: US 6,234,475 B1
(45) Date of Patent: May 22, 2001

(54) CONVEYING DEVICE FOR INDIVIDUAL SHEETS

(75) Inventors: Peter Weigel, deceased, late of Borchen, by Brigitte Weigel, Frederike Weigel, Gregor Weigel, heirs; by Michaela Weigel, heiress, Paderborn; Klaus Tauchert, Villingen-Schwenningen, all of (DE)

(73) Assignee: Siemens Nixdorf Informationssyteme Aktiengesellschaft, Paderborn (DE)

( * ) Notice: Subject to any disclaimer, the term of this patent is extended or adjusted under 35 U.S.C. 154(b) by 0 days.

(21) Appl. No.: 09/367,615

(22) PCT Filed: Jan. 20, 1998

(86) PCT No.: PCT/DE98/00167

§ 371 Date: Nov. 8, 1999

§ 102(e) Date: Nov. 8, 1999

(87) PCT Pub. No.: WO98/36385

PCT Pub. Date: Aug. 20, 1998

(30) Foreign Application Priority Data

Feb. 17, 1997 (DE) ..... 197 06 130

(51) Int. Cl.[7] ..... B65H 39/10
(52) U.S. Cl. ..... 271/303; 198/468.01
(58) Field of Search ..... 271/303, 304, 271/9.13; 198/468.01, 463.6

(56) References Cited

U.S. PATENT DOCUMENTS

| | | | | |
|---|---|---|---|---|
| 4,343,582 | * | 8/1982 | Lundblad et al. | 198/436 |
| 4,703,162 | * | 10/1987 | Holland-Letz et al. | 235/379 |
| 4,785,942 | * | 11/1988 | Leijenhorst et al. | 271/303 |
| 4,925,178 | * | 5/1990 | Cladders et al. | 271/303 |
| 5,472,185 | * | 12/1995 | Kollann et al. | 271/303 |

FOREIGN PATENT DOCUMENTS

| | | |
|---|---|---|
| 28 44 210 | 4/1979 | (DE) . |
| 35 13 635 | 10/1986 | (DE) . |
| 0 290 731 | 7/1993 | (EP) . |

* cited by examiner

*Primary Examiner*—H. Grant Skaggs
(74) *Attorney, Agent, or Firm*—Schiff Hardin & Waite

(57) ABSTRACT

Transporting apparatus for individual sheets, having two transporting paths which are aligned at an angle to one another. A diverter arrangement with a first diverter body, which can be adjusted in a translatory manner, and a second diverter body, which can be pivoted about its longitudinal axis synchronously with said first diverter body, serves for optionally guiding a single sheet along the first transporting path, deflecting the sheet into the second transporting path or deflecting it back from there into the first transporting path. For this purpose, a first diverter surface and a third diverter surface, which is aligned at an acute angle to the first diverter surface, are formed on the first diverter body. The second diverter body bears a second diverter surface.

14 Claims, 3 Drawing Sheets

CONVEYING DEVICE FOR INDIVIDUAL SHEETS

BACKGROUND OF THE INVENTION

The invention relates to a transporting apparatus for individual sheets, in particular banknotes, having a frame on which there are provided a first transporting path, a second transporting path, which is directed at an angle to said first transporting path, and, at the connecting location between the two transporting paths, a diverter arrangement with a first diverter surface which, together with a first frame-side directing surface, bounds a first connecting path, which leads from the first transporting path to the second transporting path, and with a second diverter surface which, together with a second frame-side directing surface, bounds a second connecting path, which leads from the second transporting path to the first transporting path, it being the case that the two diverter surfaces can be adjusted alternately such that, when the first connecting path is opened, the first transporting path is interrupted and the inlet opening from the second transporting path into the second connecting path is closed and, when the latter is opened, the inlet opening from the first transporting path into the first connecting path is closed and the first transporting path is released.

A transporting apparatus of the type mentioned above may be provided, for example, on a storage apparatus for storing banknotes, for example a winding store, it being the case that the first transporting path is guided past the outside of the store housing or frame, while the second transporting path is intended to guide into the store the banknotes which are to be stored or to guide out of the store banknotes which are to be discharged.

A transporting apparatus of the type mentioned above is known, for example, from EP 0290731 B1. In the case of the transporting apparatus described in this document, the diverter arrangement comprises a strip-like diverter body with an essentially triangular cross section. Two of the triangle sides form the first and the second diverter surfaces and are curved concavely in adaptation to the convexly curved frame-side directing surfaces. At its longitudinal ends, the diverter body is fitted on two levers, with the result that it can be pivoted about an axis parallel to its longitudinal direction. The two levers can be adjusted linearly in their longitudinal direction via a drive, with the result that the diverter body can be adjusted between a first position, in which the first diverter surface butts against the first directing surface, and a second position, in which the second diverter surface butts against a second directing surface. If the diverter body, in the first position, is pressed against the first directing surface by way of its first diverter surface, then it assumes a pivot position in which the third, straight triangle side is aligned with the frame-side surface bounding the first transporting path. The other surface of the first transporting path is formed by a fixed plate. In the second position, in which the second diverter surface is pressed onto the second directing surface, the diverter body tilts such that the first diverter surface projects into the first transporting path by way of its edge which is adjacent to the third, straight triangle side of the diverter body, with the result that the individual sheets arriving via the first transporting path are directed into the first connecting path. As a result of the combined lifting and pivoting movement, a relatively large amount of space is required for the diverter body. It is not possible for the gap to be set individually for the two connecting paths.

SUMMARY OF THE INVENTION

The object of the invention is to design a transporting apparatus of the type mentioned in the introduction such that the diverter arrangement requires only a small amount of space, allows individual setting of the width of the connecting paths and can nevertheless be produced inexpensively and straightforwardly.

This object is achieved according to the invention in that the first diverter surface and a third diverter surface, which forms an acute angle with the first diverter surface and bounds part of the transporting path, are formed on a first strip-like diverter body, which extends over the width of the transporting paths and can be adjusted in a translatory manner between a first position, in which the third diverter surface is located in a surface which bounds the first transporting path and the first connecting path is closed, and a second position, in which the third diverter surface has been lifted out of the surface which bounds the first transporting path and the first connecting path is open, in that the second diverter surface is formed on a second strip-like diverter body, which is parallel to the first diverter body and is mounted such that it can be pivoted about a pivot spindle parallel to the respective transporting plane of the transporting paths, and in that the two diverter bodies are coupled to a drive arrangement for the synchronous adjustment of the diverter bodies.

In the case of the solution according to the invention, it is possible for the two diverter bodies to be adjusted synchronously but with different adjustment paths, with the result that the connecting paths may be configured differently and may be made to have different widths. Nevertheless, the two diverter bodies can be accommodated in an extremely small amount of space. It is also possible for the diverter arrangement according to the invention to be arranged in a convexly curved surface which bounds the first transporting path on the frame side and may be combined with a transporting belt for transporting the individual sheets.

If the first and the second connecting paths, as in the case of the known solution described above, converge toward a gap between two transporting rollers of the second transporting path, it is advantageous if, between the location at which the two connecting paths converge and the roller gap, a blocking strip, which is parallel to the diverter bodies, is arranged in an adjustable manner such that, in the first position of the first diverter body, it screens those edges of the diverter bodies which are directed toward the roller gap and blocks the first connecting path and, in the second position of the first diverter body, it releases the first connecting path. This prevents the situation where sheets running to the diverter arrangement on the second transporting path strike against the first and/or second diverter body. The blocking strip reliably ensures that, in this case, the individual sheets are directed into the open, second connecting path.

Synchronous adjustment of the two diverter bodies, despite the different adjustment movements of the latter, can be easily realized inexpensively in that the first diverter body is connected to at least one rack, which is guided in an at least more or less linearly displaceable manner on the frame, in that the second diverter body is connected to at least one toothed segment, which is curved coaxially with the pivot spindle of said second diverter body, and in that the rack and the toothed segment engage with a gear-wheel arrangement, which is seated on a pivot shaft which is parallel to the pivot spindle of the second diverter body and is connected to a pivot drive. Thus, despite the different adjustment movements of the two diverter bodies, one pivot drive is sufficient for adjusting the two diverter bodies. It is also possible for the adjustment path of the two diverter bodies to be set individually in that the gear-wheel arrangement comprises a first gear wheel, which engages with the rack, and a second gear wheel, which is coaxial with the first gear wheel and engages with the toothed segment. This makes it possible to select individually the transmission ratio for the adjustment of the two diverter bodies.

The blocking strip may easily be adjusted in that it is connected to at least one toothed segment, which is mounted such that it can be pivoted about a spindle parallel to the pivot shaft of the gear-wheel arrangement and which engages with the gear-wheel arrangement. The toothed segment combined with the blocking strip, in this case, either may mesh with one of the gear wheels, which also drives the rack and/or the toothed segment which is connected to the second diverter body, or a further gear wheel may be provided if this is necessary for achieving the suitable adjustment path of the blocking strip.

The pivot drive may easily be realized in that it comprises a linear drive and an actuator which is connected to said linear drive and is articulated at a location of the gear-wheel arrangement which is remote from the axis of the latter. According to a particularly straightforward solution, the linear drive is designed such that it acts just in one direction, in which case the gear-wheel arrangement is prestressed in a pivoting direction which is counter to the direction of action of the linear drive. For example, the linear drive may be an electromagnet which acts on the actuator, which is designed as a drawing element. However, it is also possible for the linear drive to be selected such that it acts in two directions, the actuator having a high compressive strength.

In the case of a particularly preferred embodiment of the invention, the gear-wheel arrangement and the actuator are produced in a single piece, the articulation between the gear-wheel arrangement and the actuator being formed by an elastic material bridge. In the case of this embodiment, the gear-wheel arrangement and actuator may be produced, for example from plastic, as a molding. The limited pivoting angle of the gear-wheel arrangement means that the articulation or film hinge, formed by the elastic material bridge, between the gear-wheel arrangement and the actuator also has just a relatively small pivoting angle, with the result that the articulated connection is very durable.

Further features and advantages of the invention can be gathered from the following description, which explains the invention, with reference to an exemplary embodiment, in conjunction with the attached drawings:

DESCRIPTION OF THE PREFERRED EMBODIMENT

Figure 1:
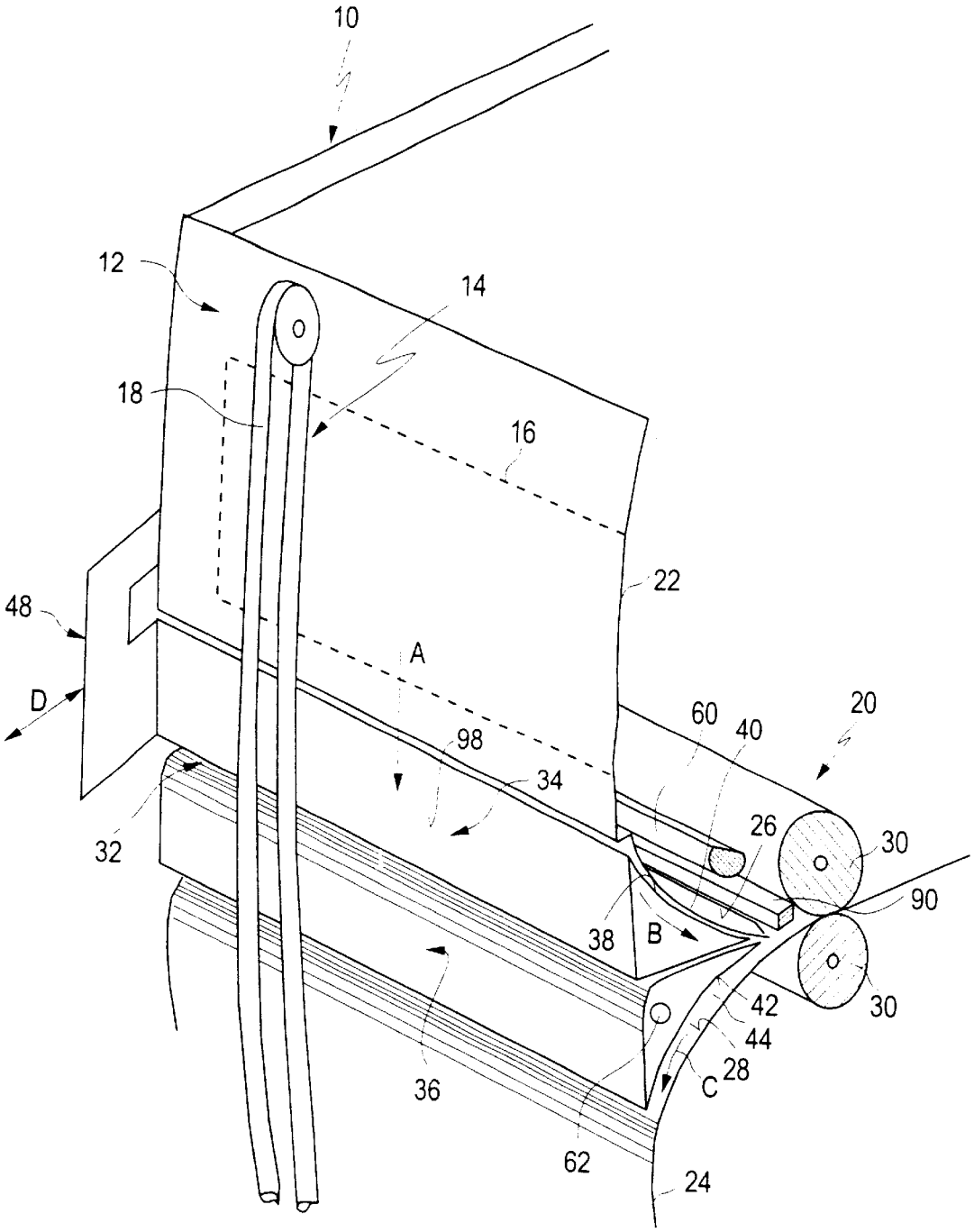
FIG. 1 shows a schematic partial section through a frame of a winding store (not otherwise illustrated) for receiving banknotes, the section plane running perpendicularly to the plane of the transporting paths.

In FIG. 1, a frame of a winding store (not otherwise illustrated any more specifically) for receiving banknotes is designated by 10. On its front side, the frame 10 has a slightly convexly curved surface 12, which constitutes one boundary surface of a first transporting path 14 for banknotes 16, which are indicated by dashed lines. The other boundary surface of the first transporting path 14 is formed by one or more belt drives 18, which may be part of the store itself or of the arrangement in which the store is installed. In a bottom region of the front side 12 of the frame 10, a second transporting path, which is designated in general terms by 20, branches into the interior of the frame 10 from the first transporting path 14 such that the two transporting paths 14 and 20 butt against one another in the form of a T. The second transporting path leads to the actual winding store (not illustrated here specifically).

The wall parts 22 and 24, forming the front side 12 of the frame 10, on either side of the access and outlet opening of the second transporting path 20 are curved convexly toward the frame interior, with the formation of a first frame-side directing surface 26 and a second frame-side directing surface 28, such that they converge in the direction of a gap between two transporting rollers 30 of the second transporting path 20.

Located in the inlet and outlet gap of the second transporting path, said gap being formed between the convexly curved frame-side directing surfaces 26 and 28, is a diverter arrangement which is designated in general terms by 32. By means of this diverter arrangement, individual sheets or banknotes 16 arriving in the direction of the arrow A either are routed further on the first transporting path, beyond the open-out location of the second transporting path 20, or are transferred, in the direction of the arrow B, from the first transporting path 14 onto the second transporting path 20 and/or, in the direction of the arrow C, from the second transporting path 20 onto the first transporting path 14.

The construction and the functioning of the diverter arrangement 32 will now be explained in more detail hereinbelow.

According to FIG. 1, the diverter arrangement 32 comprises a first diverter body 34, in the form of an elongate strip, and a second diverter body 36, which is parallel to the first diverter body. The two diverter bodies 34 and 36 extend over the entire width of the two transporting paths 14 and 20 and each has an at least more or less triangular cross section. The first diverter body 34 has a wall which is directed toward the first frame-side directing surface 26, is curved at least more or less coaxially with the latter, forms a first diverter surface 38 and, together with the frame-side directing surface 26, bounds a first connecting path 40, which leads from the first transporting path 14 to the second transporting path 20. The second diverter body has a wall which is directed toward the second frame-side directing surface 28, is curved at least more or less coaxially with the latter and forms a second diverter surface 42 which bounds a second connecting path 44, which leads from the second transporting path 20 to the first transporting path 14.

Figure 2:
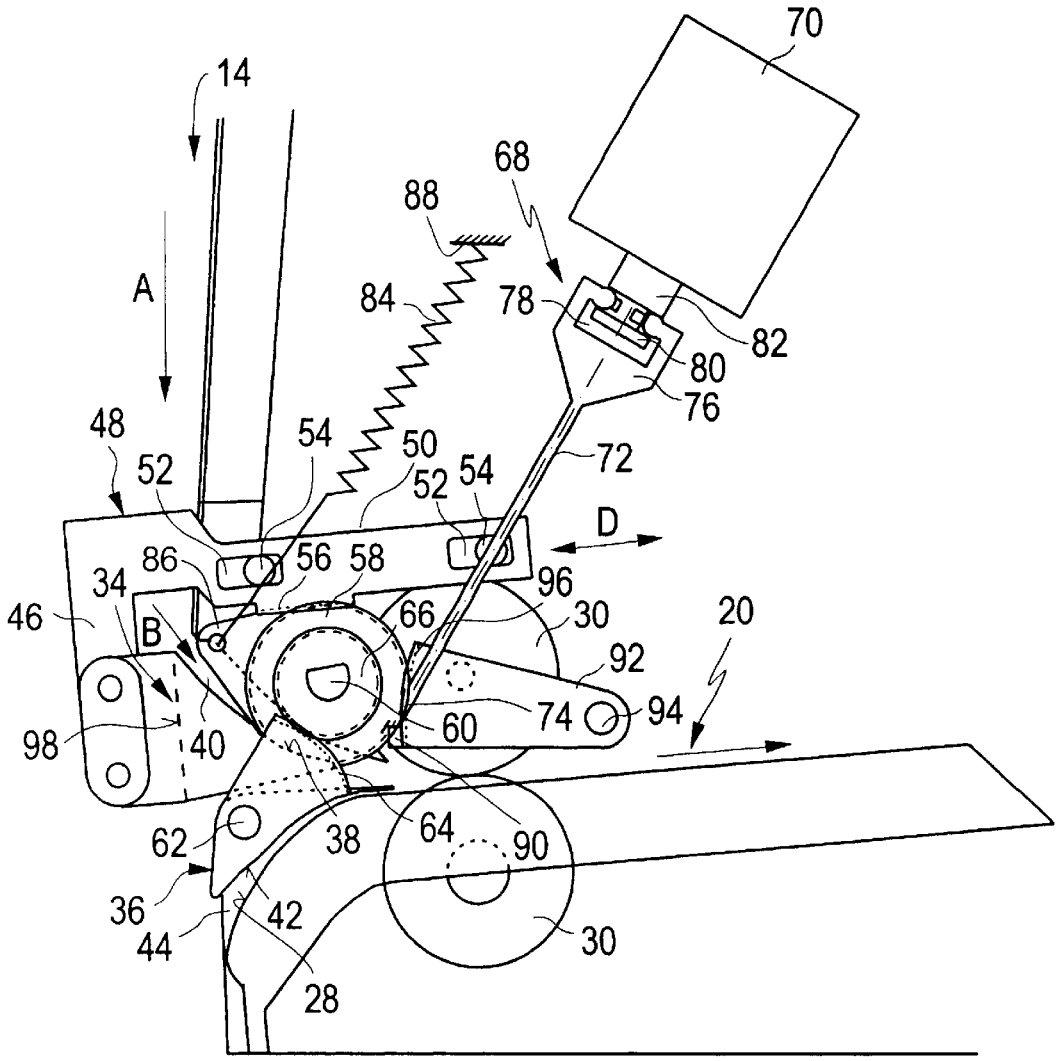
FIG. 2 shows a schematic side view of that part of the store arrangement which comprises the diverter arrangement, the diverter bodies being shown in a first position.
Figure 3:
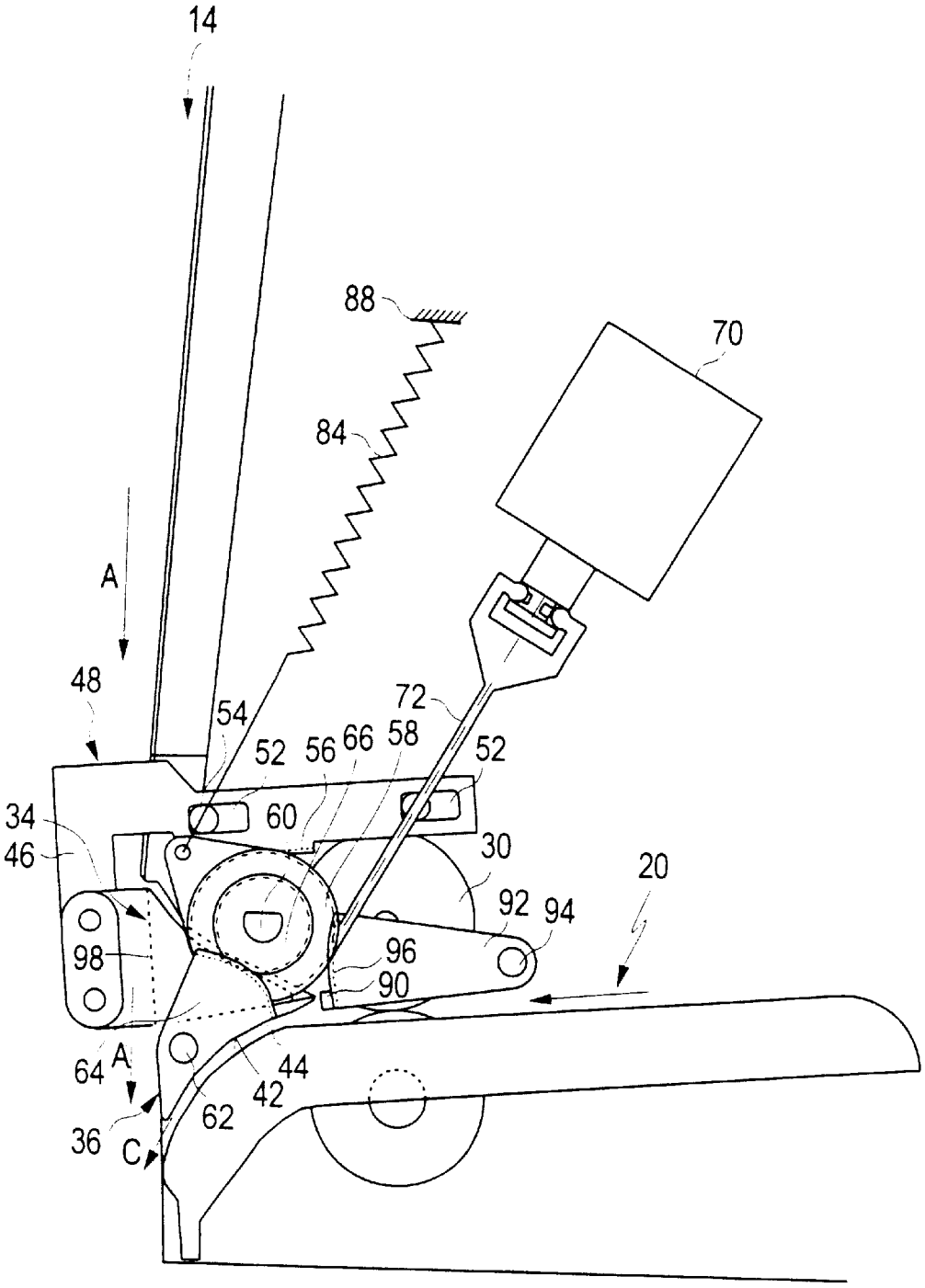
FIG. 3 shows a side view corresponding to FIG. 2, with the diverter bodies in a second position.

As far as the adjustability of the two diverter bodies 34 and 36 is concerned, you are now referred to FIGS. 2 and 3.

At its two longitudinal ends, the first diverter body 34 is fastened in each case on one leg 46 of a right-angled lever 48. By way of their other leg 50 in each case, the two levers 48 are guided, via slots 52 formed in the leg 50 and frame-side pins 54, on the side walls of the frame 10 such that they can be displaced linearly in the direction of the double arrow D. On its inside, the leg 50 is provided in each case with a toothing arrangement 56, with the result that it forms a rack which meshes with a gear wheel 58 which is arranged in a rotationally fixed manner on a pivot shaft 60 parallel to the longitudinal direction of the diverter body 34 and to the axes of the transporting rollers 30. Rotation of the gear wheel 58 causes linear displacement of the angle lever 48 and thus adjustment of the first diverter body 34, essentially perpendicular to the front side 12 of the frame 10, between the positions illustrated in FIGS. 2 and 3.

The second diverter body 36 is mounted in the side walls of the frame 10 such that it can be pivoted about a pivot spindle 62 parallel to the pivot shaft 60. Furthermore, at its longitudinal ends, the second diverter body 36 is connected in each case to a sheet-like toothed segment 64, of which the toothed rim is curved coaxially with the pivot spindle 62 and meshes with a gear wheel 66, which is likewise seated in a rotationally fixed manner on the shaft 60. A rotary movement of the gear wheel 66 thus causes a pivoting movement of the second diverter body 36, about the pivot spindle 62, between the positions illustrated in FIGS. 2 and 3.

The gear wheels 58 and 66 are rotated, together with the pivot shaft 60, via a pivot drive 68, which comprises an electromagnet 70, which operates the tension, and a drawing element 72, which is connected to said electromagnet, acts on the circumference of the gear wheel 58 and is connected to the latter in an articulated manner at 74. The two gear wheels 58 and 66 are preferably produced, together with the drawing element 72, from plastic in a single piece, the point of articulation 74 being formed by an elastic material bridge. The drawing element 72 has a head part 76 with a C-groove 78, in which a head 80 of the plunger-type armature 82 of the electromagnet 70 engages. In the opposite direction, the pivot shaft 60, together with the gear wheels 58 and 66, is adjusted by a spring 84, which acts, on the one hand, on a flange 86, connected in a rotationally fixed manner to the shaft 62, and, on the other hand, on a frame-side point 88.

Arranged between the gap between the transporting rollers 30 and those borders of the two diverter bodies 34 and 36 which are oriented toward the frame interior is a blocking strip 90, which is directed parallel to the pivot spindle 60 and, at its longitudinal ends, is connected to a rocker 92 in each case. The two rockers are mounted such that they can be pivoted about a spindle 94 parallel to the pivot spindle 60 and, at their end which is remote from the axis, bear a toothed segment 96 via which they engage with the gear wheel 58. When the gear wheel 58 is rotated, the two rockers 92, and thus the blocking strip 90, are thus also adjusted between the positions illustrated in FIGS. 2 and 3.

The apparatus which has been described thus far operates as follows:

In the case of that position of the diverter bodies 34 and 36 which is illustrated in FIGS. 1 and 3, the first diverter body 34 is fully incorporated in the open-out opening of the second transporting path, with the result that its outside 98 is aligned with the front side 12 of the frame 10, and thus with one boundary surface of the first transporting path 14. This position has been reached by rotation of the gear wheels 58 and 66 in the clockwise direction, the angle lever 48 having been displaced to the extent where the pins 54 butt against the left-hand ends of the slots which are illustrated in FIG. 3. This limits the adjustment movement. Rotation of the gear wheel 66 in the clockwise direction has, at the same time, pivoted the diverter body 36 in the anticlockwise direction, with the result that the second connecting path 44 between the second transporting path 20 and the first transporting path 14 has been opened. Finally, the same movement of the gear wheels 58 and 66 has adjusted the blocking strip 90 downward, with the result that the latter is now located in front of that edge of the second diverter body 36 which is oriented toward the transporting rollers 30.

Banknotes 16 arriving on the first transporting path 14 in the direction of the arrow A are guided past the diverter arrangement 32 and thus remain on the first transporting path 14. In the same position of the diverter arrangement 32, however, it is also possible for banknotes to be discharged from the second transporting path 20, through the second connecting path 44, in the direction of the arrow C (FIG. 1), onto the first transporting path, on which they are then guided away in the direction of the arrow A.

If the pivot shaft 60, together with the gear wheels 58 and 66, is adjusted in the anticlockwise direction, counter to the action of the spring 84, via the electromagnet 70 and the drawing element 72, then the angle lever 48 and thus also the first diverter body 34 are adjusted to the left in FIGS. 2 and 3. As a result, the outer surface 98 of the first diverter body 34 is lifted out of the front side 12 of the frame 10, said front side bounding the first transporting path 14, with the result that the first connecting path 40 opens. At the same time, the second diverter body 36 is pivoted in the clockwise direction and the blocking strip 90 is lifted by virtue of the rockers 92 being pivoted in the clockwise direction about the spindle 94. This releases the path for banknotes which arrive on the first transporting path in the direction of the arrow A and are then deflected, by way of the first diverter surface 38, into the first connecting path 40 in the direction of the arrow B, with the result that they pass into the gap between the transporting rollers 30 of the second transporting path 20. If the electromagnet 70 is deactivated, then all the parts spring back, under the action of the spring 84, into the position illustrated in FIGS. 1 and 3.

What is claimed is:

1. A transporting apparatus for individual sheets, said apparatus having a frame on which there are provided a first transporting path, a second transporting path, which is directed at an angle to said first transporting path, and, at the connecting location between the two transporting paths, a diverter arrangement with a first diverter surface which, together with a first frame-side directing surface, bounds a first connecting path, which leads from the first transporting path to the second transporting path, and with a second diverter surface which, together with a second frame-side directing surface, bounds a second connecting path, which leads from the second transporting path to the first transporting path, so that the two diverter surfaces can be adjusted alternately such that, when the first connecting path is opened, the first transporting path is interrupted and the inlet opening from the second transporting path into the second connecting path is closed and, when the latter is opened, the inlet opening from the first transporting path into the first connecting path is closed and the first transporting path is released, the improvements comprising the first diverter surface and a third diverter surface, which forms an acute angle with the first diverter surface and bounds part of the first transporting path being formed on a first strip-like diverter body, which extends over the width of the transporting paths and can be adjusted in a translatory manner between a first position, in which the third diverter surface is located in a surface which bounds the first transporting path and the first connecting path is closed, and a second position, in which the third diverter surface has been lifted out of the surface, which bounds the first transporting path, and the first connecting path is open, and the second diverter surface being formed on a second strip-like diverter body, which is parallel to the first diverter body and is mounted to be pivoted about a pivot spindle parallel to the respective transporting plane of the transporting paths, and in that the two diverter bodies being coupled to a drive arrangement for the synchronous adjustment of the diverter bodies.

2. A transporting apparatus according to claim 1, wherein the surface, which bounds the first transporting path on the frame side, is curved convexly.

3. A transporting apparatus according to claim 1, wherein the first and the second connecting paths converge toward a gap between two transporting rollers of the second transporting path, and between a location at which the two connecting paths converge and the roller gap, a blocking strip, which is parallel to the diverter bodies, is arranged in an adjustable manner so that, in the first position of the first diverter body, the blocking strip screens those edges of the diverter bodies which are directed toward the roller gap and blocks the first connecting path and, in the second position of the first diverter body, the blocking strip releases the first connecting path.

4. A transporting apparatus according to claim 3, wherein the blocking strip is connected to at least one toothed segment, which is mounted so that the toothed segment can be pivoted about a spindle parallel to the pivot shaft of the gear-wheel arrangement and which engages with the gear-wheel arrangement.

5. A transporting apparatus according to claim 1, wherein the first diverter body is connected to at least one rack, which is guided in a linearly displaceable manner on the frame, the second diverter body is connected to at least one toothed segment, which is curved coaxially with the pivot spindle of said second diverter body, and the rack and the toothed segment engage with a gear-wheel arrangement, which is seated on a pivot shaft which is parallel to the pivot spindle of the second diverter body and is connected to a pivot drive.

6. A transporting apparatus according to claim 5, wherein the gear-wheel arrangement comprises a first gear wheel, which engages with the rack, and a second gear wheel, which is coaxial with the first gear wheel and engages with the toothed segment.

7. A transporting apparatus according to claim 5, wherein the pivot drive has a linear drive and an actuator which is connected to said linear drive and is articulated at a location of the gear-wheel arrangement which is remote from the axis of the latter.

8. A transporting apparatus according to claim 7, wherein the linear drive acts in one direction, and in that the gear-wheel arrangement is prestressed in a pivoting direction which is counter to the direction of action of the linear drive.

9. A transporting apparatus according to claim 7, wherein the linear drive is an electromagnet.

10. A transporting apparatus according to claim 7, wherein the linear drive acts in two directions, and in that the actuator has a high compressive strength.

11. A transporting apparatus according to claim 7, wherein the gear-wheel arrangement and the actuator are produced in a single piece, the articulation between the gear-wheel arrangement and the actuator being formed by an elastic material bridge.

12. A transporting apparatus for individual sheets having a frame on which there are provided a first transporting path, a second transporting path, which is directed at an angle to said first transporting path, and, at the connecting location between the two transporting paths, a diverter arrangement with a first diverter surface which, together with a first frame-side directing surface, forms a first connecting path, which leads from the first transporting path to the second transporting path, and with a second diverter surface which, together with a second frame-side directing surface, forms a second connecting path, which leads from the second transporting path to the first transporting path, so that the two diverter surfaces can be adjusted alternately so that, when the first connecting path is opened, the first transporting path is interrupted and the inlet opening from the second transporting path into the second connecting path is closed and, when the latter is opened, the inlet opening from the first transporting path into the first connecting path is closed and the first transporting path is released, and so that the first diverter surface and a third diverter surface, which forms an acute angle with the first diverter surface and forms part of the first transporting path, are formed on a first diverter body, which can be adjusted in a translatory manner between a first position, in which the third diverter surface is located in a surface which forms the first transporting path and the first connecting path is closed, and a second position, in which the third diverter surface can be lifted out of the surface, which forms the first transporting path, the improvement comprising the first diverter body being strip-like and extends over the width of the transporting paths and being adjustable in a translatory manner, so that, with the first diverter body adjusted into the second position, the first connecting path is open, and the second diverter surface being formed on a second strip-like diverter body, which is parallel to the first diverter body and is mounted so that the second strip-like diverter body can be pivoted about a pivot spindle parallel to the respective transporting plane of the transporting paths, and the two diverter bodies are coupled to a drive arrangement for the synchronous adjustment of the diverter bodies.

13. A transporting apparatus according to claim 12, wherein the surface, which forms the first transporting path on the frame side, is curved convexly.

14. A transporting apparatus according to claim 12, wherein the first and the second connecting paths converge toward a gap between two transporting rollers of the second transporting path, and wherein between the location at which the two connecting paths converge and the roller gap, a blocking strip, which is parallel to the diverter bodies, is arranged in an adjustable manner so that, in the first position of the first diverter body, the blocking strip screens those edges of the diverter bodies which are directed toward the roller gap and blocks the first connecting path and, in the second position of the first diverter body, the blocking strip is retracted from the first connecting path.

* * * * *